US008581125B2

(12) United States Patent
Chen

(10) Patent No.: US 8,581,125 B2
(45) Date of Patent: Nov. 12, 2013

(54) ILLUMINATED KEYBOARD

(75) Inventor: Bo-An Chen, Taipei (TW)

(73) Assignee: Primax Electronics Ltd., Taipei (TW)

( * ) Notice: Subject to any disclaimer, the term of this patent is extended or adjusted under 35 U.S.C. 154(b) by 300 days.

(21) Appl. No.: 12/940,551

(22) Filed: Nov. 5, 2010

(65) Prior Publication Data

US 2012/0080299 A1 Apr. 5, 2012

(30) Foreign Application Priority Data

Oct. 1, 2010 (TW) ..... 99133474 A

(51) Int. Cl.
*H01H 9/26* (2006.01)

(52) U.S. Cl.
USPC ..... 200/5 A

(58) Field of Classification Search
USPC ..... 200/5 A, 517, 310–317, 341–345
See application file for complete search history.

(56) References Cited

U.S. PATENT DOCUMENTS

| | | | | |
|---|---|---|---|---|
| 7,057,125 | B1 * | 6/2006 | Tsai | 200/310 |
| 7,351,928 | B2 * | 4/2008 | Harada | 200/302.1 |
| 7,608,792 | B1 * | 10/2009 | Tsai | 200/310 |
| 8,247,714 | B2 * | 8/2012 | Tsai | 200/5 A |
| 2009/0021400 | A1 * | 1/2009 | Tsai | 341/22 |
| 2012/0012448 | A1 * | 1/2012 | Pance et al. | 200/5 A |
| 2012/0018289 | A1 * | 1/2012 | Hwa | 200/5 A |
| 2012/0048701 | A1 * | 3/2012 | Liu | 200/5 A |
| 2012/0055771 | A1 * | 3/2012 | Lin | 200/314 |

* cited by examiner

*Primary Examiner* — Edwin A. Leon
(74) *Attorney, Agent, or Firm* — Kirton McConkie; Evan R. Witt

(57) ABSTRACT

An illuminated keyboard includes a supporting plate, a transparent frame plate, a key, a light source and a membrane switch circuit module. The light source is arranged between the key and the transparent frame plate. The transparent frame plate is disposed on said supporting plate for enhancing the structural strength of the illuminated keyboard. The light beam emitted by the light source is incident into the transparent frame plate, reflected by the supporting plate, and transmitted through the transparent frame plate, the membrane switch circuit module and the key. In such way, the key is illuminated.

5 Claims, 7 Drawing Sheets

ILLUMINATED KEYBOARD

FIELD OF THE INVENTION

The present invention relates to a keyboard, and more particularly to an illuminated keyboard with a luminous function.

BACKGROUND OF THE INVENTION

Generally, the common input device of a computer system includes for example a mouse, a keyboard device or a trackball. Via the keyboard device, the user may input characters and instructions into the computer system. As a consequence, most users and most manufacturers pay much attention to the development of keyboard devices.

Hereinafter, the configurations and functions of a conventional keyboard device will be illustrated with reference to FIG. 1. FIG. 1 is a schematic view illustrating the outward appearance of a conventional keyboard device. The surface of the conventional keyboard device 1 includes plural keys. These keys include ordinary keys 10, numeric keys 11 and function keys 12. When one or more keys are depressed by the user, a corresponding signal is issued to the computer, and thus the computer executes a function corresponding to the depressed key or keys. For example, when the ordinary keys 10 are depressed, corresponding English letters or symbols are inputted into the computer system. In addition, the function keys 12 (F1~F12) can be programmed to cause corresponding application programs to provide certain functions.

With the maturity of computing technologies, the conventional keyboard 1 that has basic functions fails to meet the users' requirements. For this reason, the keyboard manufacturers make efforts in designing novel keyboards with diversified functions. Recently, an illuminated keyboard with a luminous function has been disclosed. FIG. 2 is a schematic side view illustrating a conventional illuminated keyboard. As shown in FIG. 2, the illuminated keyboard 2 comprises a key 20, a metallic base plate 21, a membrane switch circuit module 22, a light source 23 and a light guide plate 24. The key 20 comprises a keycap 201, a scissors-type connecting member 202 and an elastic element 203. From top to bottom, the keycap 201, the scissors-type connecting member 202, the elastic element 203, the membrane switch circuit module 22, the metallic base plate 21 and the light guide plate 24 of the illuminated keyboard 2 are sequentially shown. The light source 23 is arranged beside the light guide plate 24. Via a flexible printed circuit (FPC), the light source 23 is connected with a circuit board (not shown) of the illuminated keyboard 2. In addition, electricity is transmitted to the light source 23 through the flexible printed circuit 25. The light source 23 is used for emitting a light beam B. An example of the light source 23 is a light emitting diode (LED). In addition, the elastic element 203 is a transparent rubbery element.

In FIG. 2, the light guide plate 24 is used to guide the light beam B, and thus the light beam B can be diffused to the whole keyboard. In addition, the light guide plate 24 is used to change the propagating direction of the light beam B, so that the light beam B is moved upwardly. The membrane switch circuit module 22 is disposed on the metallic base plate 21. Moreover, the metallic base plate 21 has a first fixing structure 211, a second fixing structure 212 and two partition plate openings 213. Via the partition plate openings 213, the light beam B will be incident into the membrane switch circuit module 22. The keycap 201 comprises a first keycap fixing structure 2011, a second keycap fixing structure 2012 and a light-transmissible region 2013. The scissors-type connecting member 202 comprises a first frame 2021 and a second frame 2022. A first end 2021A of the first frame 2021 is connected with the second fixing structure 212. A second end 2021B of the first frame 2021 is connected with the first keycap fixing structure 2011. A first end 2022A of the second frame 2022 is connected with the first fixing structure 211. A second end 2022B of the second frame 2022 is connected with the second keycap fixing structure 2012.

Please refer to FIG. 2 again. When the key 20 is depressed and moved downwardly with respect to the metallic base plate 21, the first frame 2021 and the second frame 2022 of the scissors-type connecting member 202 are switched from an open-scissors state to a stacked state. In addition, as the keycap 201 is moved downwardly to press the elastic element 203, the elastic element 203 is sustained against the membrane switch circuit module 22, and thus a key signal corresponding to the depressed key 20 is generated. Whereas, when the depressing force exerted on the key 20 is eliminated, an elastic force provided by the elastic element 203 is acted on the keycap 201. Due to the elastic force, the keycap 201 is moved upwardly with respect to the metallic base plate 21, and the first frame 2021 and the second frame 2022 of the scissors-type connecting member 202 are switched from the stacked state to the open-scissors state. Consequently, the keycap 201 is returned to its original position. After the light beam B is emitted by the light source 23, the light beam B is directed to the light guide plate 24. By the light guide plate 24, the propagating direction of the light beam B is changed. Consequently, a portion of the light beam B is sheltered by the metallic base plate 21, but the other portion of the light beam B is guided toward the membrane switch circuit module 22 through the partition plate openings 213. Then, the light beam B successively passes through the membrane switch circuit module 22, the elastic element 203 and the light-transmissible region 2013 of the keycap 201, thereby illuminating the key 20.

The conventional illuminated keyboard, however, still has some drawbacks. For example, since the majority of the light beam B emitted by the light source 23, which is disposed under the metallic base plate 21, is sheltered by the metallic base plate 21, the conventional illuminated keyboard fails to be uniformly illuminated.

SUMMARY OF THE INVENTION

The present invention relates to an illuminated keyboard, which can be illuminated in a more uniform fashion.

In accordance with an aspect of the present invention, there is provided an illuminated keyboard. The illuminated keyboard includes a supporting plate, a transparent frame plate, at least one key and a light source. The transparent frame plate is disposed on the supporting plate. The key is connected with the transparent frame plate, and includes a light-transmissible region. The light source is arranged between the key and the supporting plate for emitting a light beam. The light beam successively passes through the supporting plate, the transparent frame plate and the light-transmissible region of the key.

In an embodiment, the illuminated keyboard further includes a membrane switch circuit module. The membrane switch circuit module is arranged between the transparent frame plate and the key, and includes an upper wiring board, a partition plate and a lower wiring board. The upper wiring board has at least one upper contact. The partition plate is disposed under the upper wiring board, and has a partition plate opening corresponding to the upper contact. The lower wiring board is disposed under the partition plate, and has a lower contact corresponding to the upper contact.

In an embodiment, the illuminated keyboard further includes a light-guiding film layer, which is arranged between the supporting plate and the transparent frame plate for guiding the light beam, so that the light beam successively passes through the supporting plate, the light-guiding film layer, the transparent frame plate, the membrane switch circuit module and the light-transmissible region of the key.

In an embodiment, the key includes a keycap, a scissors-type connecting member and an elastic element. The keycap is exposed to a surface of the illuminated keyboard, wherein the light-transmissible region is included in the keycap. The scissors-type connecting member is arranged between the transparent frame plate and the keycap for connecting the transparent frame plate and the keycap, and allowing the keycap to be moved upwardly and downwardly with respect to the transparent frame plate. The elastic element is arranged between the membrane switch circuit module and the keycap. When the keycap is depressed, the elastic element is compressed and sustained against the membrane switch circuit module, so that a key signal corresponding to the key is generated. Whereas, when a depressing force exerted on the key is eliminated, an elastic force provided by the elastic element is acted on the keycap, so that the keycap is returned to an original position.

In an embodiment, the keycap includes a first keycap fixing structure and a second keycap fixing structure, the transparent frame plate includes a first frame plate fixing structure and a second frame plate fixing structure, and the first frame plate fixing structure and the second frame plate fixing structure are integrally formed with the transparent frame plate. The scissors-type connecting member includes a first frame and a second frame. A first end of the first frame is connected with the second frame plate fixing structure, a second end of the first frame is connected with the first keycap fixing structure, a first end of the second frame is connected with the second keycap fixing structure, and a second end of the second frame is connected with the first frame plate fixing structure.

In an embodiment, the light source is a light emitting diode (LED).

In an embodiment, the supporting plate is made of a metallic material.

In an embodiment, the transparent frame plate is made of a transparent material.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
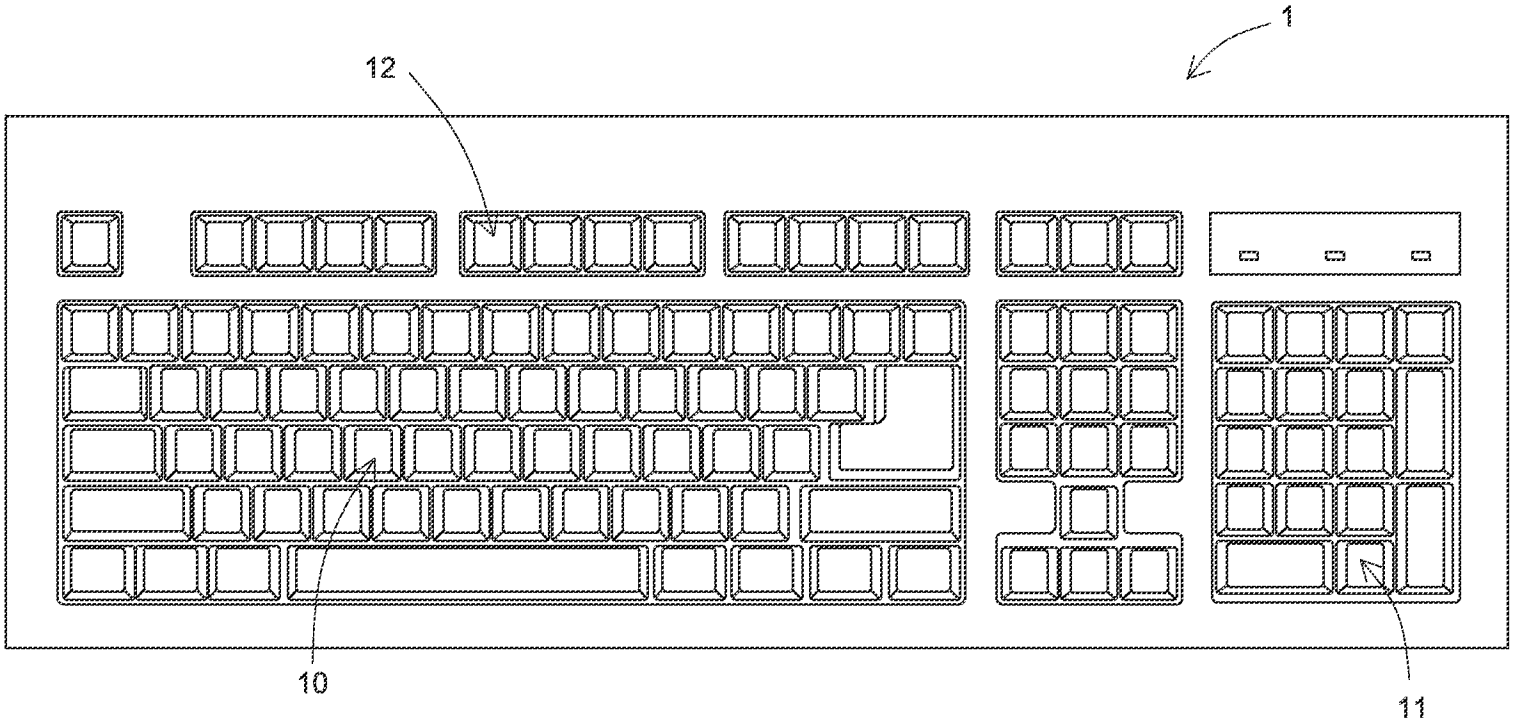
FIG. 1(PRIOR ART)
FIG. 1 is a schematic view illustrating the outward appearance of a conventional keyboard device.
Figure 2:
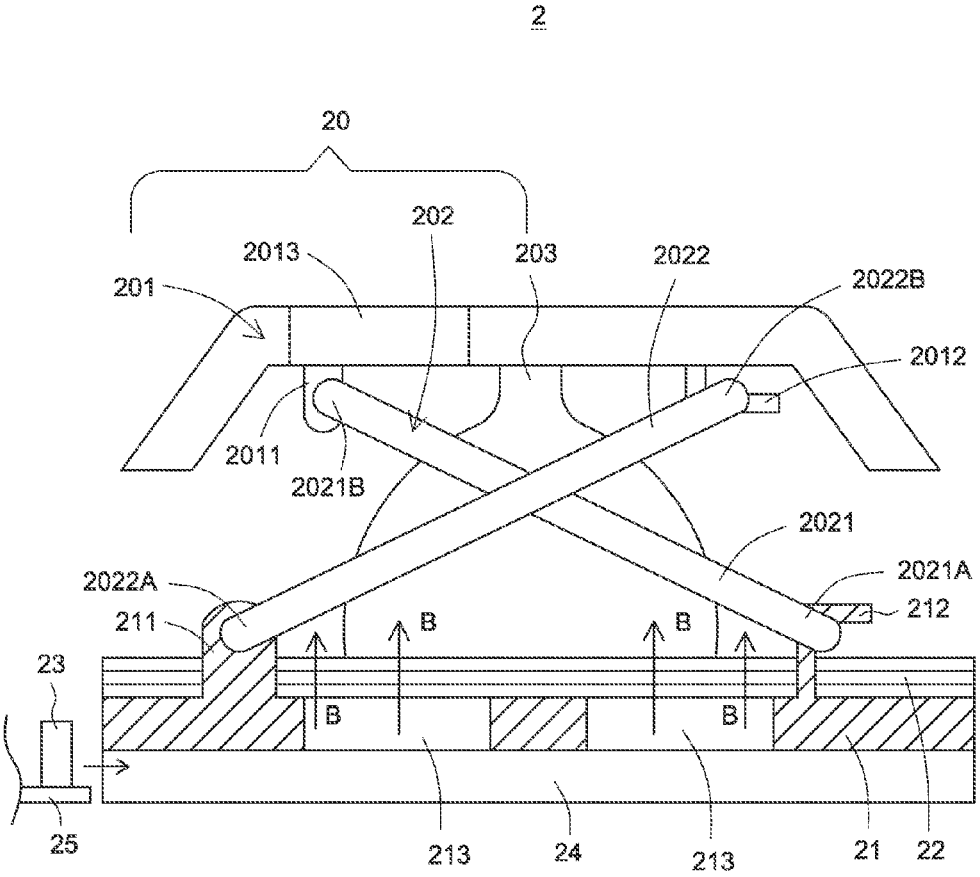
FIG. 2(PRIOR ART)
FIG. 2 is a schematic side view illustrating a conventional illuminated keyboard.
Figure 3:
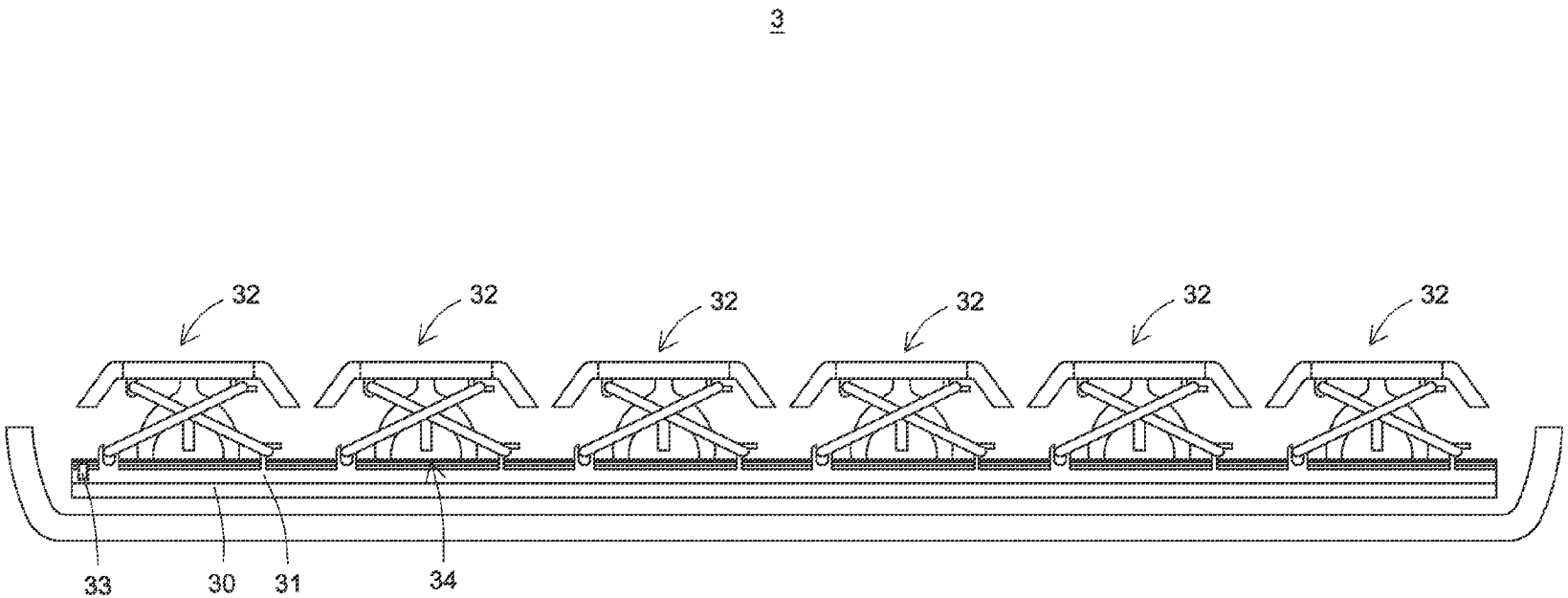
FIG. 3 is a schematic view illustrating an illuminated keyboard according to a first embodiment of the present invention.

For obviating the drawbacks encountered from the prior art, the present invention provides an illuminated keyboard. FIG. 3 is a schematic view illustrating an illuminated keyboard according to a first embodiment of the present invention. As shown in FIG. 3, the illuminated keyboard 3 comprises a supporting plate 30, a transparent frame plate 31, plural keys 32, a row of light sources 33 and a membrane switch circuit module 34. For clarification, only a light source 33 is shown in the drawing. The plural keys 32 are disposed on the membrane switch circuit module 34. The membrane switch circuit module 34 is disposed on the transparent frame plate 31. The transparent frame plate 31 is disposed on the supporting plate 30. An example of the light source 23 is a light emitting diode (LED). It is noted the number of light sources 33 is not equivalent to the number of keys 32. For the whole illuminated keyboard 3, the light beams emitted by the row of light sources 33 are sufficient to illuminate all of the keys 32.

Figure 4:
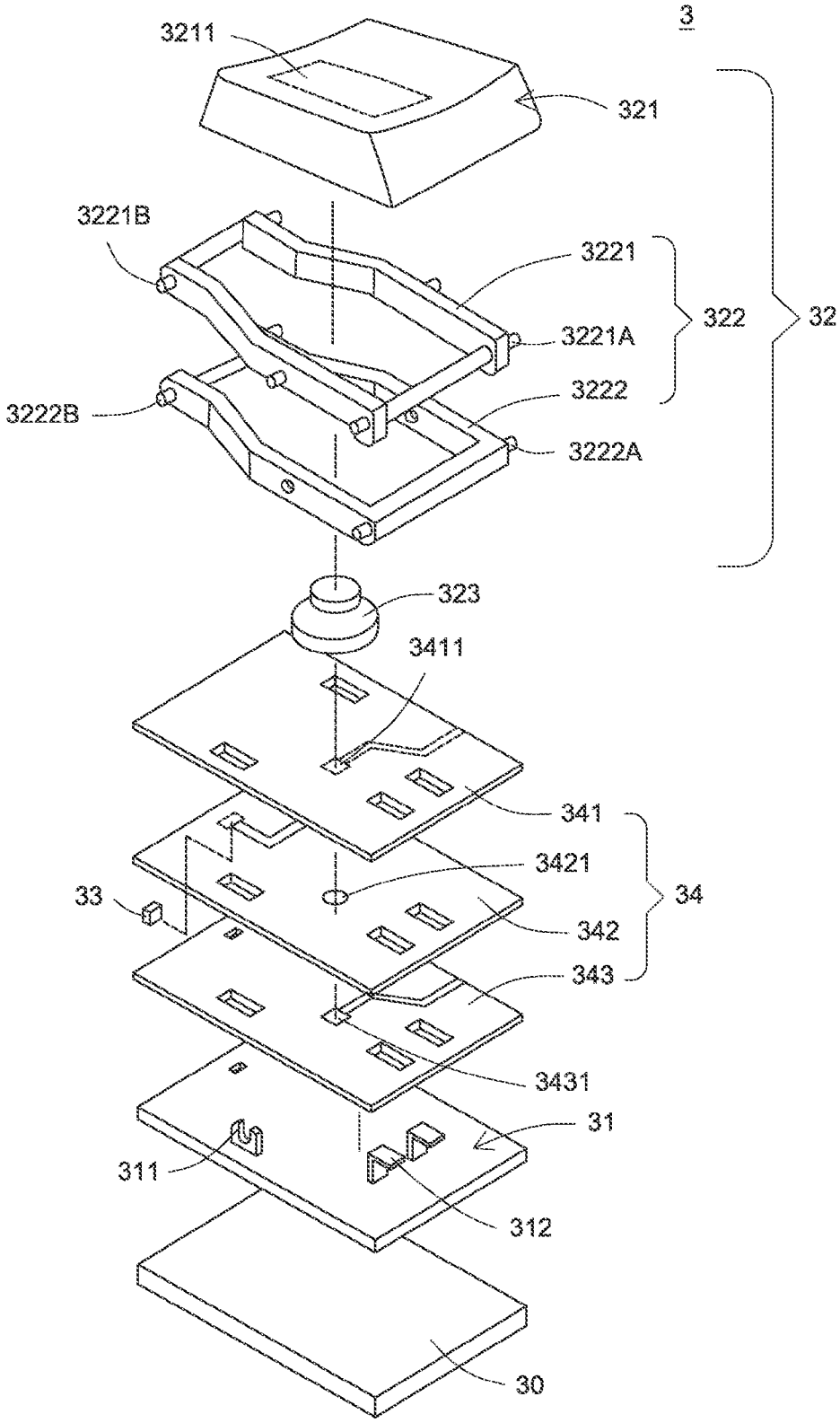
FIG. 4 is a schematic exploded view illustrating a portion of the illuminated keyboard according to the first embodiment of the present invention.

Hereinafter, the detailed configurations of the illuminated keyboard 3 will be illustrated by referring to a key 32 of FIG. 3 as well as FIG. 4. Please refer to FIG. 4, which is a schematic exploded view illustrating a portion of the illuminated keyboard according to the first embodiment of the present invention. In FIG. 4, a supporting plate 30, a transparent frame plate 31, a key 32, a light source 33 and a membrane switch circuit module 34 are shown. The transparent frame plate 31 comprises a first frame plate fixing structure 311 and a second frame plate fixing structure 312. It is preferred that the first frame plate fixing structure 311 and the second frame plate fixing structure 312 are integrally formed with the transparent frame plate 31. In this embodiment, the transparent frame plate 31 is made of a transparent material, so that the transparent frame plate 31 is light-transmissible. Moreover, the key 32 comprises a keycap 321, a scissors-type connecting member 322 and an elastic element 323. The keycap 321 has a light-transmissible region 3211, which is arranged on a top surface of the keycap 321. The scissors-type connecting member 322 comprises a first frame 3221 and a second frame 3222. In addition, the elastic element 323 is a transparent rubbery element.

The light source 33 is arranged between the transparent frame plate 31 and the key 32. The light source 33 is used for emitting a light beam B' (see FIG. 5). The supporting plate 30 is used for reflecting the light beam B'. In this embodiment, the supporting plate 30 is made of a metallic material. In addition, the supporting plate 30 made of the metallic material should provide good optical reflectivity. The membrane switch circuit module 34 is arranged between the transparent frame plate 31 and the key 32. Moreover, the membrane switch circuit module 34 comprises an upper wiring board 341, a partition plate 342 and a lower wiring board 343. The upper wiring board 341 has at least one upper contact 3411. The partition plate 342 has a partition plate opening 3421. The lower wiring board 343 has a lower contact 3431 corresponding to the upper contact 3411. When the membrane switch circuit module 34 is pressed, the upper contact 3411 is inserted into the partition plate opening 3421 to touch the lower contact 3431, so that electrical connection between the upper contact 3411 and the lower contact 3431 is established.

Figure 5:
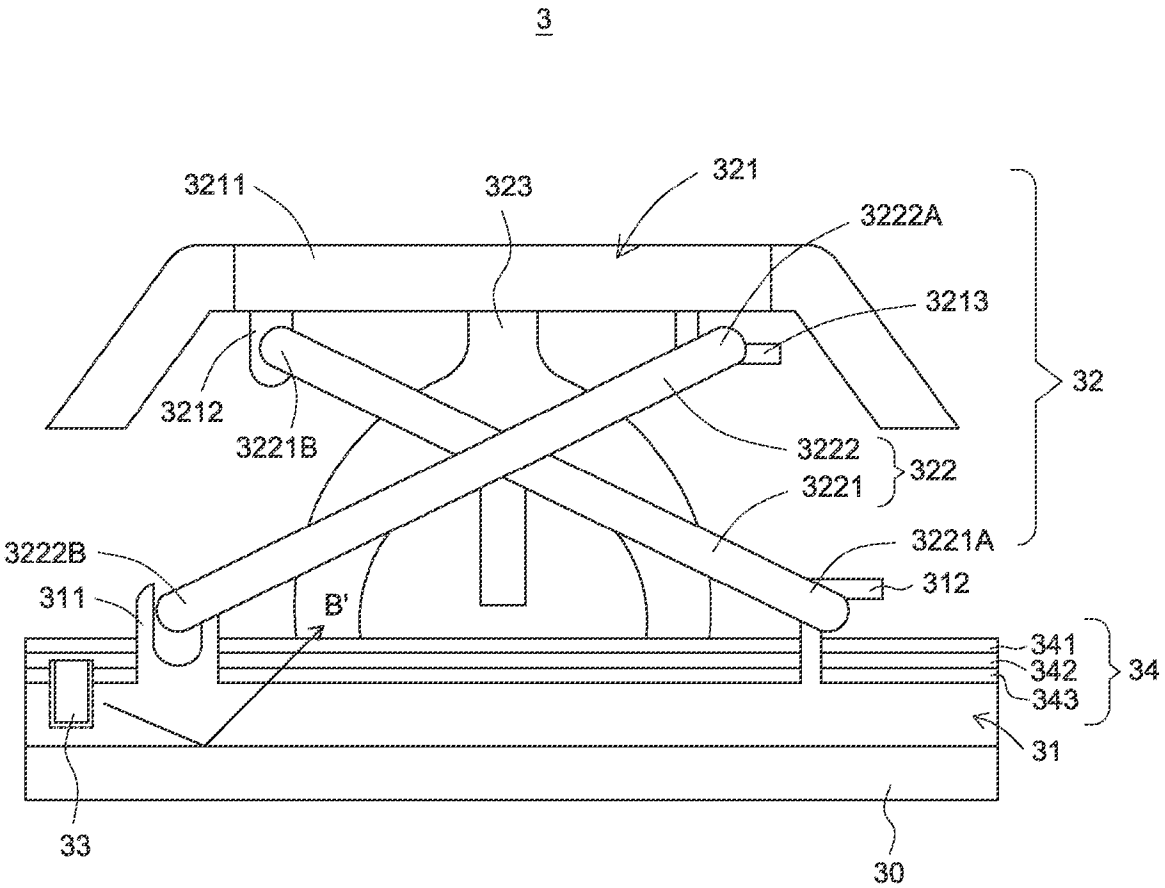
FIG. 5 is a schematic side view illustrating a portion of the illuminated keyboard according to the first embodiment of the present invention.

Hereinafter, the relations between the components of the illuminated keyboard 3 will be illustrated with reference to FIG. 5. FIG. 5 is a schematic side view illustrating a portion of the illuminated keyboard according to the first embodiment of the present invention. In the illuminated keyboard 3, the transparent frame plate 31 is disposed on the supporting plate 30, the light source 33 is arranged between the transparent frame plate 31 and the membrane switch circuit module 34, and the membrane switch circuit module 34 is disposed over the light source 33. In the membrane switch circuit module 34, the upper wiring board 341 is laminated on the partition plate 342, and the partition plate 342 is laminated on the lower wiring board 343. The elastic element 323 is disposed on the membrane switch circuit module 34. The keycap 321 is disposed on the elastic element 323. The scissors-type connecting member 322 is arranged between the transparent frame plate 31 and the keycap 321. The scissors-type connecting member 322 is used for connecting the transparent frame plate 31 and the keycap 321, and allowing the keycap 321 to be moved upwardly and downwardly with respect to the transparent frame plate 31. In the scissors-type connecting member 322, a first end 3221A of the first frame 3221 is connected with the second frame plate fixing structure 312, and a second end 3221B of the first frame 3221 is connected with a first keycap fixing structure 3212. In addition, a first end 3222A of the second frame 3222 is connected with a second keycap fixing structure 3213, and a second end 3222B of the second frame 3222 is connected with the first frame plate fixing structure 311.

Please refer to FIG. 5 again. When the key 32 is depressed and moved downwardly with respect to the transparent frame plate 31, the first frame 3221 and the second frame 3222 of the scissors-type connecting member 322 are switched from an open-scissors state to a stacked state. In addition, as the keycap 321 is moved downwardly to press the elastic element 323, the elastic element 323 is sustained against the membrane switch circuit module 34, and thus a key signal corresponding to the depressed key 32 is generated. Whereas, when the depressing force exerted on the key 32 is eliminated, an elastic force provided by the elastic element 323 is acted on the keycap 321. Due to the elastic force, the keycap 321 is moved upwardly with respect to the transparent frame plate 31, and the first frame 3221 and the second frame 3222 of the scissors-type connecting member 322 are switched from the stacked state to the open-scissors state. Consequently, the keycap 321 is returned to its original position.

After the light beam B' is emitted by the light source 33, a portion of the light beam B' is projected downwardly and directed to the transparent frame plate 31, and propagated within the transparent frame plate 31. Then, the light beam B' passes through the transparent frame plate 31 and is reflected by the supporting plate 30, so that the propagating direction of the light beam B' is changed. Then, the light beam B' is directed to the membrane switch circuit module 34 through the transparent frame plate 31. After the light beam B' passes through the membrane switch circuit module 34, the light beam B' passes through the elastic element 323 and is directed to the keycap 321. Then, the light beam B' passes through the light-transmissible region 3211 of the keycap 321, thereby illuminating the illuminated keyboard 3.

From the above discussions, the light beam B' emitted by the source 33, which is arranged between the transparent frame plate 31 and the membrane switch circuit module 34, is propagated along an optical path. Along the optical path, the light beam B' is projected downwardly and directed to the transparent frame plate 31, reflected by the supporting plate 30, and directed upwardly to the transparent frame plate 31, the membrane switch circuit module 34 and the light-transmissible region 3211 of the keycap 321.

It is noted that the light-transmissible region 3211 of the keycap 321 is a character region or a symbol region at the surface of the keycap 321. For example, the light-transmissible region 3211 is an A-letter character region corresponding to the key A. Due to the above configurations, the light beam B' may pass through the light-transmissible region 3211, thereby illuminating the character region or the symbol region of the key 32.

Figure 6:
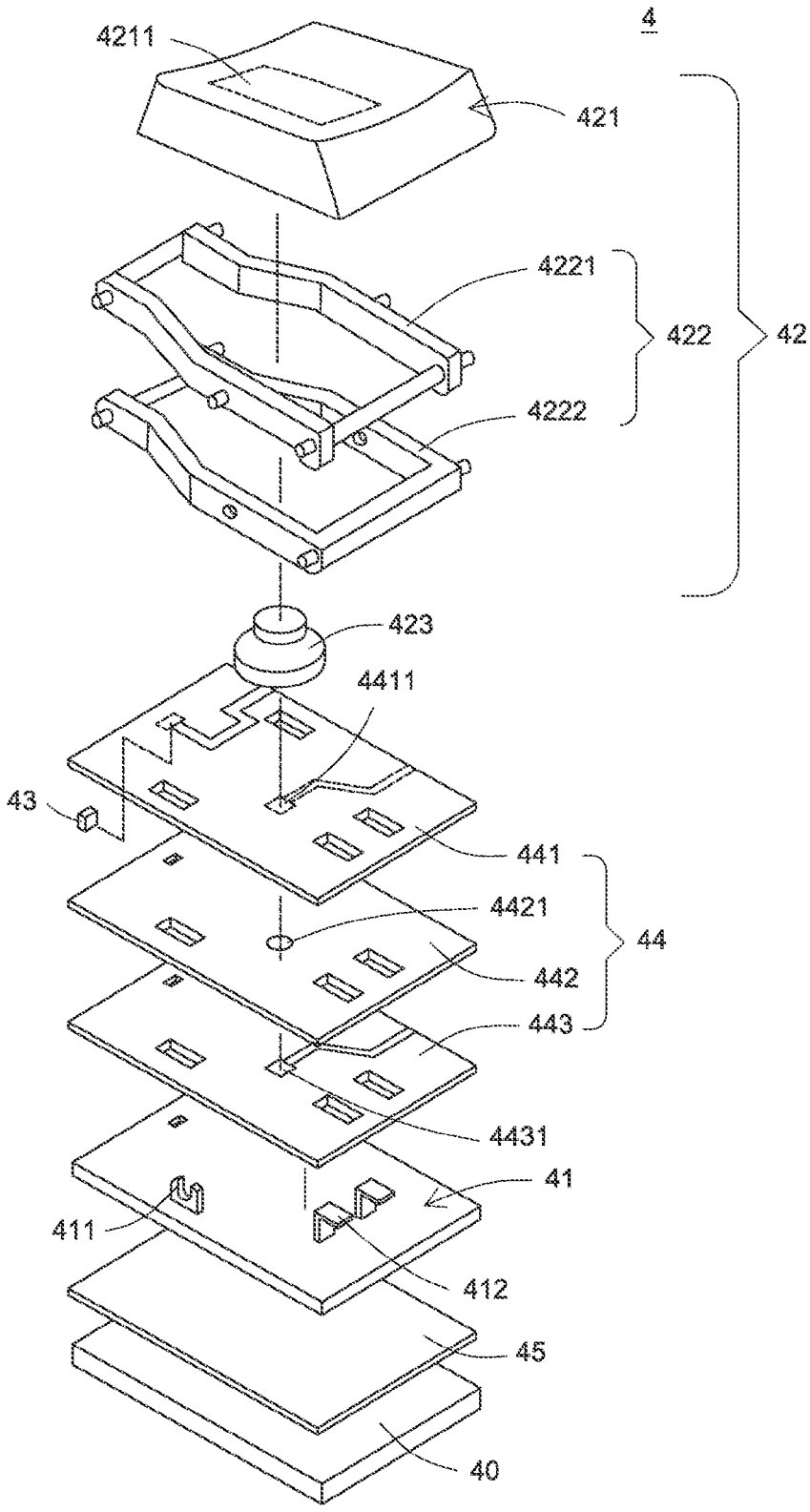
FIG. 6 is a schematic exploded view illustrating a portion of the illuminated keyboard according to a second embodiment of the present invention.

The present invention further provides a second embodiment of an illuminated keyboard. FIG. 6 is a schematic exploded view illustrating a portion of the illuminated keyboard according to a second embodiment of the present invention. As shown in FIG. 6, the illuminated keyboard 4 comprises a supporting plate 40, a transparent frame plate 41, at least one key 42 (only a key 42 is shown), a light source 43, a membrane switch circuit module 44 and a light-guiding film layer 45. The transparent frame plate 41 comprises a first frame plate fixing structure 411 and a second frame plate fixing structure 412. It is preferred that the first frame plate fixing structure 411 and the second frame plate fixing structure 412 are integrally formed with the transparent frame plate 41. In this embodiment, the transparent frame plate 41 is made of a transparent material, so that the light beam is transmissible through the transparent frame plate 41 and not hindered by the transparent frame plate 41. Moreover, the key 42 comprises a keycap 421, a scissors-type connecting member 422 and an elastic element 423. The keycap 421 has a light-transmissible region 4211, which is arranged on a top surface of the keycap 421. The scissors-type connecting member 422 comprises a first frame 4221 and a second frame 4222.

Figure 7:
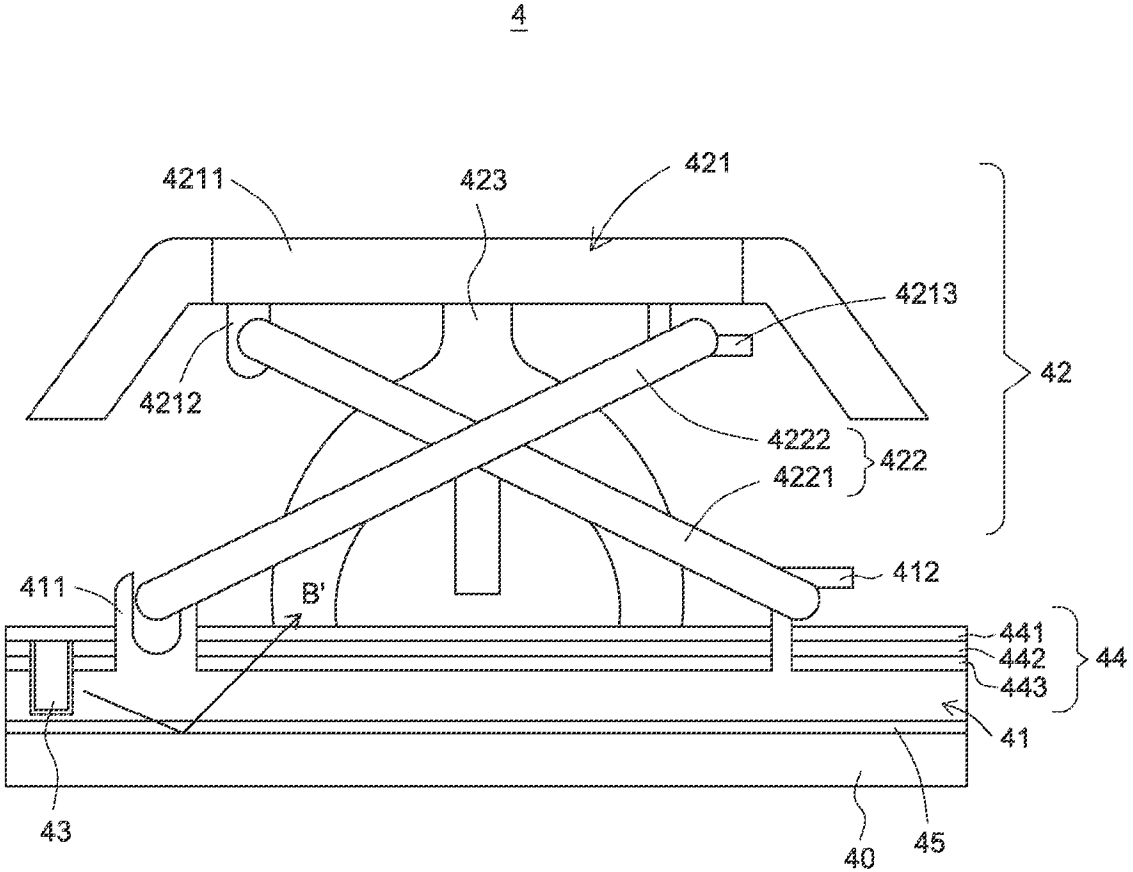
FIG. 7 is a schematic side view illustrating a portion of the illuminated keyboard according to the second embodiment of the present invention.

The light source 43 is used for emitting a light beam B' (see FIG. 7). An example of the light source 43 is a light emitting diode (LED). The supporting plate 40 is used for reflecting the light beam B'. The membrane switch circuit module 44 comprises an upper wiring board 441, a partition plate 442 and a lower wiring board 443. The upper wiring board 441 has at least one upper contact 4411. The partition plate 442 has a partition plate opening 4421. The lower wiring board 443 has a lower contact 4431 corresponding to the upper contact 4411. The light-guiding film layer 45 is used to guide the light beam B', so that the light beam B' can be diffused to the transparent frame plate 41 that is under other keys 42 or the propagating direction of the light beam B' can be changed.

Hereinafter, the relations between the components of the illuminated keyboard 4 will be illustrated with reference to FIG. 7. FIG. 7 is a schematic side view illustrating a portion of the illuminated keyboard according to the second embodiment of the present invention. In the illuminated keyboard 4, the transparent frame plate 41 is disposed on the supporting plate 40. The membrane switch circuit module 44 is disposed on the transparent frame plate 41. The light source 43 is arranged between the transparent frame plate 41 and the membrane switch circuit module 44. The light-guiding film layer 45 is arranged between the supporting plate 40 and the transparent frame plate 41. In the membrane switch circuit module 44, the upper wiring board 441 is laminated on the partition plate 442, and the partition plate 442 is laminated on the lower wiring board 443. The keycap 421 is disposed on the elastic element 423. The elastic element 423 is disposed on the membrane switch circuit module 44. When the keycap 421 is depressed and the elastic element 423 is compressed, the elastic element 423 is sustained against the membrane switch circuit module 44, which is disposed under the elastic element 423. The scissors-type connecting member 422 is arranged between the transparent frame plate 41 and the keycap 421. The scissors-type connecting member 422 is used for connecting the transparent frame plate 41 and the keycap 421, and allowing the keycap 421 to be moved upwardly and downwardly with respect to the transparent frame plate 41. The relations between the first frame 4221 and the second frame 4222 of the scissors-type connecting member 422 and the transparent frame plate 41 and the keycap 421 are similar to those of the first embodiment, and are not redundantly described herein.

Please refer to FIG. 7 again. When the key 42 is depressed and moved downwardly with respect to the transparent frame plate 41, the first frame 4221 and the second frame 4222 of the scissors-type connecting member 422 are switched from an open-scissors state to a stacked state. In addition, as the keycap 421 is moved downwardly to press the elastic element 423, the elastic element 423 is sustained against the membrane switch circuit module 44, and the upper contact 4411 of the upper wiring board 441 and the lower contact 4431 of the lower wiring board 443 are electrically connected with each other. Consequently, a key signal corresponding to the depressed key 42 is generated. Whereas, when the depressing force exerted on the key 42 is eliminated, an elastic force provided by the elastic element 423 is acted on the keycap 421. Due to the elastic force, the keycap 421 is moved upwardly with respect to the transparent frame plate 41, and the first frame 4221 and the second frame 4222 of the scissors-type connecting member 422 are switched from the stacked state to the open-scissors state. Consequently, the keycap 421 is returned to its original position.

After the light beam B' is emitted by the light source 43, the light beam B' is projected downwardly and directed to the transparent frame plate 41, and propagated within the transparent frame plate 41. Then, the light beam B' passing through the transparent frame plate 41 is incident into the light-guiding film layer 45. The light beam B' passing through the light-guiding film layer 45 is reflected by the supporting plate 40, so that the propagating direction of the light beam B' is changed. Then, the light beam B' is directed to the membrane switch circuit module 44 through the light-guiding film layer 45 and the transparent frame plate 41. After the light beam B' passes through the membrane switch circuit module 44 and the elastic element 423, the light beam B' is directed to the keycap 421. Then, the light beam B' passes through the light-transmissible region 4211 of the keycap 421, thereby illuminating the illuminated keyboard 4. The portion of the light beam B' that is not transmitted through the light-guiding film layer 45 and not reflected by the supporting plate 40 will be guided by the light-guiding film layer 45, so that the light beam B' will be diffused to the transparent frame plate 41 under other keys 42.

From the above discussions, if the influence of the light-guiding film layer 45 to guide the light beam B' is neglected, the light beam B' emitted by the source 43, which is arranged between the transparent frame plate 41 and the membrane switch circuit module 44, is propagated along an optical path. Along the optical path, the light beam B' is projected downwardly and directed to the transparent frame plate 41, incident downwardly into the light-guiding film layer 45, reflected by the supporting plate 40, incident upwardly into the light-guiding film layer 45, and directed upwardly to the transparent frame plate 41, the membrane switch circuit module 44 and the light-transmissible region 4211 of the keycap 421.

In this embodiment, since the light-guiding film layer 45 is arranged between the transparent frame plate 41 and the supporting plate 40, the light beam B' can be diffused to the transparent frame plate 41 under other keys 42. As a consequence, the illuminated keyboard 4 can be illuminated in a more uniform fashion.

From the above description, the transparent frame plate of the illuminated keyboard of the present invention has functions similar to the metallic base plate of the conventional illuminated keyboard, i.e. the function of connecting to the scissors-type connecting member. That is, through the scissors-type connecting member, the connection between the key and the transparent frame plate is similar to the connection between the key and the conventional metallic base plate. Moreover, since the transparent frame plate is made of a transparent material, the light source may be disposed above or below the transparent frame plate, and the majority of the light beam may be transmitted through the transparent frame plate downwardly or upwardly without being sheltered by the conventional metallic base plate. In this situation, the brightness of the light beam passing through the keycap is enhanced. Moreover, since the majority of the light beam is not hindered by the conventional metallic base plate, the problem of non-uniformly illuminating the illuminated keyboard will be minimized. Moreover, for increasing the structural strength, the illuminated keyboard of the present invention further comprises a supporting plate under the transparent frame plate. Due to the supporting plate, the structural strength of the illuminated keyboard is enhanced, and the possibility of bending or damaging the illuminated keyboard will be minimized.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An illuminated keyboard, comprising:

a supporting plate;

a transparent frame plate disposed on said supporting plate;

at least one key connected with said transparent frame plate, and comprising a light-transmissible region;

a light source arranged between said key and said supporting plate for emitting a light beam, wherein said light beam successively passes through said transparent frame plate, is reflected by said supporting plate, and passes through said transparent frame plate and said light-transmissible region of said key;

a membrane switch circuit module, which is arranged between said transparent frame plate and said key, wherein said membrane switch circuit module comprises:

an upper wiring board having at least one upper contact;

a partition plate disposed under said upper wiring board, and having a partition plate opening corresponding to said upper contact; and a lower wiring board disposed under said partition plate, and having a lower contact corresponding to said upper contact;

wherein said key comprises:

a keycap exposed to a surface of said illuminated keyboard, wherein said light-transmissible region is included in said keycap;

a scissors-type connecting member arranged between said transparent frame plate and said keycap for connecting said transparent frame plate and said keycap, and allowing said keycap to be moved upwardly and downwardly with respect to said transparent frame plate; and an elastic element arranged between said membrane switch circuit module and said keycap, wherein when said keycap is depressed, said elastic element is compressed and sustained against said membrane switch circuit module, so that a key signal corresponding to said key is generated, wherein when a depressing force exerted on said key is eliminated, an elastic force provided by said elastic element is acted on said keycap, so that said keycap is returned to an original position, wherein said keycap comprises a first keycap fixing structure and a second keycap fixing structure, wherein said transparent frame plate comprises a first frame plate fixing structure and a second frame plate fixing structure, and said first frame plate fixing structure and said second frame plate fixing structure are integrally formed with said transparent frame plate, wherein said scissors-type connecting member comprises a first frame and a second frame, wherein a first end of said first frame is connected with said second frame plate fixing structure, a second end of said first frame is connected with said first keycap fixing structure, a first end of said second frame is connected with said second keycap fixing structure, and a second end of said second frame is connected with said first frame plate fixing structure.

2. The illuminated keyboard according to claim 1 further comprising a light-guiding film layer, which is arranged between said supporting plate and said transparent frame plate for guiding said light beam, so that said light beam successively passes through said transparent frame plate and said light-guiding film layer, is reflected by said supporting plate, and passes through said light-guiding film layer, said transparent frame plate, said membrane switch circuit module and said light-transmissible region of said key.

3. The illuminated keyboard according to claim 1 wherein said light source is a light emitting diode (LED).

4. The illuminated keyboard according to claim 1 wherein said supporting plate is made of a metallic material.

5. The illuminated keyboard according to claim 1 wherein said transparent frame plate is made of a transparent material.

* * * * *